US012209359B2

(12) United States Patent
Liao et al.

(10) Patent No.: US 12,209,359 B2
(45) Date of Patent: Jan. 28, 2025

(54) POLYVINYL CHLORIDE ARTIFICIAL LEATHER WITHOUT A FOAMING STRUCTURE

(71) Applicant: NAN YA PLASTICS CORPORATION, Taipei (TW)

(72) Inventors: Te-Chao Liao, Taipei (TW); Wei-Sheng Cheng, Taipei (TW); Chao-Tung Wu, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 304 days.

(21) Appl. No.: 17/903,023

(22) Filed: Sep. 5, 2022

(65) Prior Publication Data

US 2023/0106419 A1 Apr. 6, 2023

(30) Foreign Application Priority Data

Sep. 14, 2021 (TW) ..... 110134129

(51) Int. Cl.
*D06N 3/08* (2006.01)
*D06N 3/00* (2006.01)

(52) U.S. Cl.
CPC ..... *D06N 3/08* (2013.01); *D06N 3/0059* (2013.01); *D06N 3/0063* (2013.01); *D06N 2209/067* (2013.01); *D06N 2211/28* (2013.01)

(58) Field of Classification Search
CPC ..... D06N 3/08; D06N 3/0059; D06N 3/0063; D06N 2209/067; D06N 2211/28
See application file for complete search history.

(56) References Cited

U.S. PATENT DOCUMENTS

2011/0166271 A1* 7/2011 Hong ..... C07C 69/78 560/81
2015/0112008 A1 4/2015 Patil et al.
(Continued)

FOREIGN PATENT DOCUMENTS

CN 103898772 A 7/2014
CN 107190521 A 9/2017
(Continued)

OTHER PUBLICATIONS

[NPL-1] Li et al. (CN 108049198 A); May 18, 2018 (EPO machine translation to English). (Year: 2018).*
(Continued)

*Primary Examiner* — Maria V Ewald
*Assistant Examiner* — Donald M Flores, Jr.
(74) *Attorney, Agent, or Firm* — Li & Cai Intellectual Property Office

(57) ABSTRACT

A polyvinyl chloride artificial leather without a foaming structure is provided. The polyvinyl chloride artificial leather includes a base fabric layer and a top fabric layer directly formed on the base fabric layer. The top fabric layer has a solid structure extendedly formed from one surface of the top fabric layer to the base fabric layer, and the solid structure is formed by a fabric composition. The solid structure has a predetermined thickness. The fabric composition includes 40 to 70 parts by weight of a polyvinyl chloride resin and 30 to 60 parts by weight of a polymer plasticizer. A weight average molecular weight of the polymer plasticizer is within a range from 1,500 to 6,000, a molecular structure of the polymer plasticizer has at least one soft segment that is in a linear shape, and the at least one soft segment has an ether group.

12 Claims, 1 Drawing Sheet

(56) References Cited

U.S. PATENT DOCUMENTS

| | | | | |
|---|---|---|---|---|
| 2016/0002846 | A1* | 1/2016 | Yoshimoto ..... | D06M 23/08<br>252/8.57 |
| 2018/0148891 | A1 | 5/2018 | Kim et al. | |

FOREIGN PATENT DOCUMENTS

| | | | | |
|---|---|---|---|---|
| CN | 107366166 | A | | 11/2017 |
| CN | 108049198 | A | * | 5/2018 |
| CN | 111058294 | A | | 4/2020 |
| CN | 112030569 | A | | 12/2020 |
| CN | 112080948 | A | | 12/2020 |
| JP | 2003306877 | A | | 10/2003 |
| KR | 1020180045544 | A | | 5/2018 |
| TW | 201500200 | A | | 1/2015 |

OTHER PUBLICATIONS

Ming Zhao, Sheng-Gang He, Chun-Hua Wu, "Development of polyester PVC processing aid", The Chemical Engineer, Issue 6, Dec. 27, 1990(Dec. 27, 1990), pp. 13-15.

Xue Zhen-Rong, Wang Hao, Gu Xue, "Seat Leather Production Process is Introduced with the Odor of Improvement Research", Westleather, No. 5, vol. 39, Mar. 15, 2017(Mar. 15, 2017), pp. 56-59.

* cited by examiner

100a

100

POLYVINYL CHLORIDE ARTIFICIAL LEATHER WITHOUT A FOAMING STRUCTURE

CROSS-REFERENCE TO RELATED PATENT APPLICATION

This application claims the benefit of priority to Taiwan Patent Application No. 110134129, filed on Sep. 14, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a polyvinyl chloride artificial leather, and more particularly to a polyvinyl chloride artificial leather without a foaming structure.

BACKGROUND OF THE DISCLOSURE

Polyvinyl chloride (i.e., PVC) is a main material for producing and developing an artificial leather, and is widely applied in automotive interiors. The polyvinyl chloride that has a high degree of aggregation has a high melting temperature, and the melted polyvinyl chloride has poor fluidity, thereby causing processing difficulty.

The polyvinyl chloride is added with a plasticizer for improving the fluidity of the melted polyvinyl chloride, so as to reduce a processing temperature and facilitate processing and production. However, a phenolic acid plasticizer used in a conventional technique has a pungent odor, and other additives (e.g., a foaming agent) added during a processing process of the polyvinyl chloride may also have a pungent odor.

In addition, a surface of the artificial leather is usually treated to improve a surface property of the artificial leather, and a conventional surface treatment is mainly carried out by use of a solvent surface treatment agent. However, the disadvantage of the solvent surface treatment agent is its relatively high odor level. According to the Volkswagen odor test standard PV3900C3, an odor level of a conventional surface-treated artificial leather is greater than or equal to 4.0, which can seriously affect pleasantness of a user during use. The conventional solvent surface treatment agent may also include harsh solvents (e.g., toluene and xylene) that are harmful to health.

Further, a conventional polyvinyl chloride artificial leather usually includes a compact top fabric layer and a foaming layer that provides a leather feeling. However, the conventional foaming layer includes a foaming structure generated by using a foaming agent, and may still emit a pungent odor.

In recent years, much research has been dedicated to improving the odor level of the polyvinyl chloride artificial leather.

CN107190521A discloses a polyvinyl chloride artificial leather having a slight odor. The artificial leather sequentially includes a base fabric layer, a PVC leather layer, and a paint layer. The plasticizer used in this patent includes epoxidized soybean oil and phenolic plasticizers. In order to provide a leather feeling, the foaming agent is still used to generate the foaming structure.

CN107366166A discloses a polyvinyl chloride artificial leather that has no reproductive toxicity, which includes a polyvinyl chloride surface layer, a polyvinyl chloride foaming layer, and an aqueous paint layer coated on the polyvinyl chloride surface layer. The aqueous paint layer does not include N-methylpyrrolidone and N-ethylpyrrolidone, and environmental requirements of low VOC and low odor are satisfied at the same time. However, in order to provide a leather feeling, the foaming agent is still used to generate the foaming structure.

In the above-mentioned polyvinyl chloride artificial leather, since the foaming agent (especially a chemical foaming agent) is used to generate the foaming structure, such polyvinyl chloride artificial leather may still emit a pungent odor.

In the technical field of the polyvinyl chloride artificial leather, there is still room for improvement in the related art for reducing the odor level of the polyvinyl chloride artificial leather, so as to improve an interior environment of a vehicle and satisfy requirements of most mid- and high-class automobiles.

SUMMARY OF THE DISCLOSURE

In response to the above-referenced technical inadequacies, the present disclosure provides a polyvinyl chloride artificial leather without a foaming structure.

In one aspect, the present disclosure provides a polyvinyl chloride artificial leather without a foaming structure. The polyvinyl chloride artificial leather has an odor level lower than 3.5 measured according to the Volkswagen odor test standard PV3900C3, and includes a base fabric layer and a top fabric layer directly formed on the base fabric layer. The top fabric layer has a solid structure extendedly formed from one surface of the top fabric layer away from the base fabric layer to the base fabric layer, the solid structure is formed by a fabric composition, and the solid structure has a predetermined thickness within a range from 100 micrometers to 600 micrometers. The fabric composition includes 40 to 70 parts by weight of a polyvinyl chloride resin and 30 to 60 parts by weight of a polymer plasticizer. The polymer plasticizer has a first weight average molecular weight within a range from 1,500 to 6,000, a molecular structure of the polymer plasticizer has at least one soft segment that is in a linear shape, and the at least one soft segment has an ether group. A concentration of the at least one soft segment having the ether group in the polymer plasticizer is within a range from 10 wt % to 50 wt %, and the polymer plasticizer has a glass transition temperature within a range from −80° C. to −15° C.

In certain embodiments, no foaming layer is provided between the top fabric layer and the base fabric layer, and the solid structure of the top fabric layer does not have any foaming pores.

In certain embodiments, the at least one soft segment having the ether group is embedded at a central portion or an end portion of the molecular structure of the polymer plasticizer.

In certain embodiments, the polymer plasticizer is a high-molecular polyester prepared by a poly-condensation reaction between a dibasic acid raw material and a diol raw material, and the at least one soft segment having the ether group is formed by at least one of the dibasic acid raw material and the diol raw material.

In certain embodiments, the dibasic acid raw material is at least one selected from the group consisting of adipic acid, maleic acid, decanedioic acid, and dodecanedioic acid.

In certain embodiments, the diol raw material is at least one selected from the group consisting of diethylene glycol, triethylene glycol, tetraethylene glycol, poly-tetra-hydrofuran, propane-1,2-diol, 2-methyl-1,3-propanediol, neopentyl glycol, and 1,4-cyclohexanedimethanol.

In certain embodiments, the polymer plasticizer is further end-capped by an end-capped fatty alcohol to end the poly-condensation reaction. The end-capped fatty alcohol is a monool, and the end-capped fatty alcohol is at least one selected from the group consisting of 2-ethylhexan-1-ol, 2-propylheptanol, lauryl alcohol, diethylene glycol monobutyl ether, and diethylene glycol monomethyl ether.

In certain embodiments, the fabric composition further includes less than or equal to 15 parts by weight of a processing aid, the processing aid is an aliphatic dibasic acid ester that is in a linear shape, and the processing aid has a second weight average molecular weight within a range from 300 to 800.

In certain embodiments, the processing aid is at least one selected from the group consisting of di-octyl sebacate, di-octyl adipate, di-isononyl adipate, di-isodecyl adipate, and di-isononyl sebacate.

In certain embodiments, the fabric composition further includes 0.5 to 5 parts by weight of a stabilizer, 0 to 15 parts by weight of fillers, and 2 to 8 parts by weight of a flame retardant, and the fabric composition does not include any foaming agent.

In certain embodiments, the stabilizer is at least one selected from the group consisting of: lithium stearate, magnesium stearate, calcium stearate, barium stearate, zinc stearate, magnesium laurate, barium laurate, zinc laurate, calcium ricinoleate, barium ricinoleate, zinc ricinoleate, and zinc octoate. The fillers are at least one selected from the group consisting of: calcium carbonate, silicon dioxide, aluminium oxide, clay, talc, diatomaceous earth, and ferrite as metal oxides; glass, carbon black, and metal as fibers and powders; and glass ball, graphite, aluminum hydroxide, barium sulfate, magnesium oxide, magnesium carbonate, magnesium silicate, and calcium silicate. The flame retardant is at least one selected from the group consisting of: aluminum hydroxide, magnesium hydroxide, antimony trioxide, and zinc borate as inorganic compounds; cresyl diphenyl phosphate, trichloroethyl phosphate, trichloropropyl phosphate, and tris-dichloropropyl phosphate as phosphorus compounds; and chlorinated paraffin as a halogen compound.

In certain embodiments, the polyvinyl chloride artificial leather further includes a surface treatment layer formed on the top fabric layer. The surface treatment layer is formed by a waterborne surface treatment agent, and the waterborne surface treatment agent is a waterborne polyurethane system agent without N-ethylpyrrolidone.

Therefore, in the polyvinyl chloride artificial leather without the foaming structure provided by the present disclosure, by virtue of "a top fabric layer is directly formed on the base fabric layer, the top fabric layer has a solid structure extendedly formed from one surface of the top fabric layer away from the base fabric layer to the base fabric layer, the solid structure is formed by a fabric composition, and the solid structure has a predetermined thickness within a range from 100 micrometers to 600 micrometers" and "the fabric composition includes 40 to 70 parts by weight of a polyvinyl chloride resin and 30 to 60 parts by weight of a polymer plasticizer, in which the polymer plasticizer has a first weight average molecular weight within a range from 1,500 to 6,000, a molecular structure of the polymer plasticizer has at least one soft segment that is in a linear shape, the at least one soft segment has an ether group, a concentration of the at least one soft segment having the ether group in the polymer plasticizer is within a range from 10 wt % to 50 wt %, and the polymer plasticizer has a glass transition temperature within a range from −80° C. to −15° C.," the odor level of the polyvinyl chloride artificial leather can be effectively improved, and the top fabric layer can provide a leather feeling in the absence of any foaming structure.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
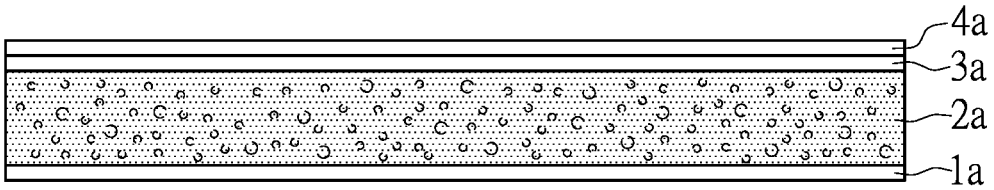
FIG. 1 is a schematic view of a laminated structure of a polyvinyl chloride artificial leather in the related art.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Polyvinyl Chloride Artificial Leather

In response to the above-mentioned technical issues in the related art, an embodiment of the present disclosure provides a polyvinyl chloride artificial leather 100, especially a polyvinyl chloride artificial leather 100 without a foaming structure. The polyvinyl chloride artificial leather 100 of the embodiment of the present disclosure does not include any foaming structure, but can still provide a leather feeling required by a conventional artificial leather.

Moreover, according to the Volkswagen odor test standard PV3900C3, an odor level of the polyvinyl chloride artificial leather 100 of the embodiment of the present disclosure is lower than 3.5, and is preferably lower than 3.0. In other words, compared to the conventional artificial leather, the odor level of the polyvinyl chloride artificial leather 100 of the embodiment of the present disclosure is relatively lower, such that pleasantness experienced by general consumers during use of a product and health requirements can be satisfied.

The design of a laminated structure of the polyvinyl chloride artificial leather 100 of the embodiment of the present disclosure is obviously different from that of the conventional artificial leather.

More specifically, as shown in FIG. 1, a polyvinyl chloride artificial leather 100*a* of the related art sequentially (from bottom to top) includes a base fabric layer 1*a*, a foaming layer 2*a*, a top fabric layer 3*a*, and a surface treatment layer 4*a* that is optionally coated. For a conventional foaming layer, a foaming structure is generally generated through a foaming agent, so as to provide the required leather feeling.

Figure 2:
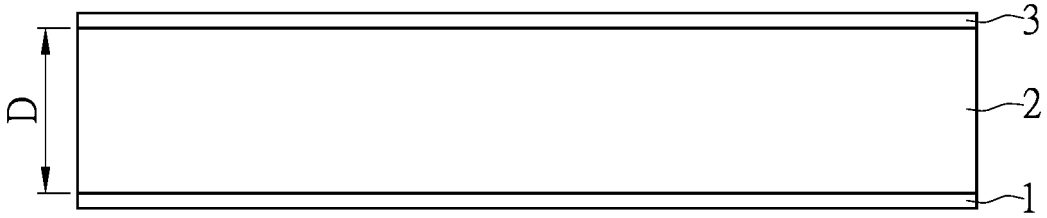
FIG. 2 is a schematic view of a laminated structure of a polyvinyl chloride artificial leather according to an embodiment of the present disclosure.

As shown in FIG. 2, different from the conventional polyvinyl chloride artificial leather 100*a*, the polyvinyl chloride artificial leather 100 of the embodiment of the present disclosure sequentially (from bottom to top) includes a base fabric layer 1, a top fabric layer 2, and a surface treatment layer 3 that is optionally coated.

The top fabric layer 2 is directly formed on one surface of the base fabric layer 1, and the surface treatment layer 3 is formed on one surface of the top fabric layer 2 away from the base fabric layer 1. The polyvinyl chloride artificial leather 100 of the embodiment of the present disclosure does not include any foaming structure.

More specifically, in the present embodiment, the top fabric layer 2 has a solid structure (i.e., a main structure of the top fabric layer 2 is solid) extendedly formed from the one surface of the top fabric layer 2 away from the base fabric layer 1 to the base fabric layer 1.

Further, the solid structure of the top fabric layer 2 is directly in contact with the base fabric layer 1, no foaming layer is between the top fabric layer 2 and the base fabric layer 1, and the solid structure of the top fabric layer 2 is not foamed and does not have any foaming structures (such as foaming pores). Specially, the top fabric layer 2 of the embodiment of the present disclosure does not include any foaming structures, but can still provide the leather feeling required by the conventional artificial leather.

It should be noted that the solid structure mentioned in the present disclosure refers to a continuous resin structure that is not foamed due to the foaming agent and does not have any foaming pores. However, during a process of manufacturing the artificial leather, due to the compatibility between different polymer materials or added materials or due to process parameters, the solid structure may still have some pores, but the pores are not foaming pores formed through a foaming process. Moreover, the leather feeling mentioned in the present disclosure refers to a tactile sensation that can be felt by a user when touching the polyvinyl chloride artificial leather 100, and said tactile sensation is like that provided by a natural leather.

In order to achieve the technical purpose above, the solid structure of the top fabric layer 2 of the embodiment of the present disclosure is formed by a fabric composition. The fabric composition primarily includes a polyvinyl chloride resin and a polymer plasticizer.

According to "parts by weight" notation, a content of the polyvinyl chloride resin is 40 to 70 parts by weight, and is preferably 45 to 65 parts by weight. In addition, a content of the polymer plasticizer is 30 to 60 parts by weight, and is preferably 35 to 55 parts by weight. Preferably, a sum of the content of the polyvinyl chloride resin and the content of the polymer plasticizer is 100 parts by weight, but the present disclosure is not limited thereto.

It should be noted that patents involving compositions are often expressed in two different ways, which are "parts by weight" notation and "percent by weight (wt %)" notation. The "parts by weight" notation of a composition reflects a proportional relationship between components in the composition. The "percent by weight (wt %)" notation needs to meet limitations of "upper and lower limit formulas" and "a sum of percentages of the components in the composition being equal to 100", while the "parts by weight" notation does not. The upper and lower limit formulas refer to: an upper limit of a content of a single component plus lower limits of contents of the remaining components must be less than or equal to 100 wt %, and a lower limit of the content of the single component plus upper limits of the contents of the remaining components must be greater than or equal to 100 wt %. Therefore, if the "parts by weight" notation is converted into the "percent by weight (wt %)" notation, this represents that a percentage based on a total of 100% is provided and the limitation of "upper and lower limit formulas" must be observed. An example of such a conversion is provided below. If a composition includes 50 parts by weight of A and 30 parts by weight of B, after the conversion, the composition includes 50/(50+30) weight percentage of A and 30/(50+30) weight percentage of B.

Specifically, the polyvinyl chloride resin is a base material of the fabric composition, and the polyvinyl chloride resin is configured to provide a mechanical strength required by the artificial leather. The polymer plasticizer is a plasticizer having a high molecular weight, which not only improves the odor level of the artificial leather but also allows the top fabric layer 2 to have the leather feeling.

If the content of the polyvinyl chloride resin is too low (e.g., lower than 40 parts by weight), or the content of the polymer plasticizer is too high (e.g., higher than 60 parts by weight), the top fabric layer 2 cannot provide the mechanical strength required by the artificial leather.

In contrast, if the content of the polyvinyl chloride resin is too high (e.g., higher than 70 parts by weight), or the content of the polymer plasticizer is too low (e.g., lower than 30 parts by weight), the top fabric layer 2 cannot provide the leather feeling required by the artificial leather.

The polyvinyl chloride resin of the embodiment of the present disclosure has a weight average molecular weight (Mw) within a range from 30,000 g/mol to 200,000 g/mol, and a glass transition temperature (Tg) within a range from 80° C. to 85° C.

The polymer plasticizer of the embodiment of the present disclosure has a special material property, so that the polyvinyl chloride resin can have a low odor level and provide the leather feeling required by the conventional artificial leather in the absence of the foaming structure.

More specifically, the polymer plasticizer of the embodiment of the present disclosure has a first weight average molecular weight within a range from 1,500 g/mol to 6,000 g/mol (preferably within a range from 2,000 g/mol to 5,000 g/mol), but the present disclosure is not limited thereto. It is worth mentioning that the first weight average molecular weight of the polymer plasticizer of the embodiment of the present disclosure is much greater than that of a conventional plasticizer (a weight average molecular weight of the conventional plasticizer is substantially within a range from 300 g/mol to 800 g/mol).

Further, the polymer plasticizer has at least one soft segment that is in a linear shape in a molecular structure thereof, and the at least one soft segment has an ether group. In addition, in the polymer plasticizer, a concentration of the at least one soft segment having the ether group is within a range from 10 wt % to 50 wt %. The concentration of the at least one soft segment having the ether group is preferably within a range from 10 wt % to 40 wt %, and is more preferably within a range from 10 wt % to 30 wt %. The polymer plasticizer has a glass transition temperature within a range from −80° C. to −15° C. (preferably within a range from −80° C. to −40° C.), but the present disclosure is not limited thereto.

Based on the special design of the molecular weight and the molecular structure of the polymer plasticizer mentioned above, the polymer plasticizer can replace the usage of the conventional plasticizer having a low molecular weight, and use of the foaming agent is not required. Accordingly, the odor level of the polyvinyl chloride artificial leather 100 can be improved, and the molecular structure of the polymer plasticizer can allow the top fabric layer 2 of the polyvinyl chloride artificial leather 100 to have the leather feeling.

More specifically, in the molecular structure of the polymer plasticizer, the at least one soft segment that has the ether group and is in the linear shape can soften a resin material within the above-mentioned concentration range and provide the leather feeling. Further, the glass transition temperature of the rein can be reduced, thereby enhancing material processability. Since the top fabric layer 2 of the embodiment of the present disclosure can provide the leather feeling in the absence of the foaming structure, the polyvinyl chloride artificial leather 100 does not need to undergo a chemical foaming process that is performed at a high temperature.

In order to provide the leather feeling, the design of a thickness range of the top fabric layer 2 is also important and should be taken into consideration. The solid structure of the top fabric layer 2 of the embodiment of the present disclosure has a predetermined thickness D within a range from 100 micrometers to 600 micrometers (preferably within a range from 150 micrometers to 550 micrometers). Accordingly, through a material selection of the fabric composition and the design of the thickness range, the top fabric layer 2 can provide the leather feeling required by the polyvinyl chloride artificial leather 100.

In one embodiment of the present disclosure, the at least one soft segment having the ether group is embedded at a central portion or an end portion of the molecular structure of the polymer plasticizer. In addition, the at least one soft segment having the ether group is located at a main chain of the polymer plasticizer and is not present in the form of a side chain, but the present disclosure is not limited thereto.

In the synthesis of the polymer plasticizer, the polymer plasticizer is a high-molecular polyester prepared by a poly-condensation reaction between a dibasic acid raw material and a diol raw material, and the at least one soft segment having the ether group is formed by at least one of the dibasic acid raw material and the diol raw material.

The dibasic acid raw material is at least one selected from the group consisting of adipic acid (AA), maleic acid (MA), decanedioic acid, dodecanedioic acid. The diol raw material is at least one selected from the group consisting of diethylene glycol (DEG), triethylene glycol (TEG), tetraethylene glycol, poly-tetra-hydrofuran (PTMEG), propane-1,2-diol (1,2-PG), 2-methyl-1,3-propanediol (MPO), neopentyl glycol (NPG), and 1,4-cyclohexanedimethanol (CHDM).

In one embodiment of the present disclosure, the polymer plasticizer is further end-capped by an end-capped fatty alcohol to end the poly-condensation reaction.

The end-capped fatty alcohol is a monool, and the end-capped fatty alcohol is at least one selected from the group consisting of 2-ethylhexan-1-ol (2-EH), 2-propylheptanol (2-PH), lauryl alcohol, diethylene glycol monobutyl ether (DGBE), and diethylene glycol monomethyl ether (DGME).

For example, in a practical application, taking a raw material price and physical processing properties of the materials into consideration, the dibasic acid raw material for synthesizing the polymer plasticizer can be adipic acid (AA). The diol raw material for synthesizing the polymer plasticizer can be diethylene glycol (DEG), which can selectively cooperate with other types of diols (e.g., 2-methyl-1,3-propanediol (MPO)). The end-capped fatty alcohol for ending the poly-condensation reaction can be diethylene glycol monomethyl ether (DGME) and/or 2-ethylhexan-1-ol (2-EH).

The molecular structure of adipic acid (AA) is as follows.

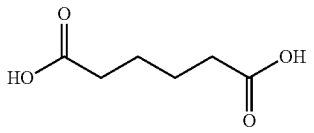

The molecular structure of diethylene glycol (DEG) having the ether group is as follows.

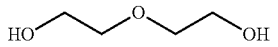

The molecular structure of 2-methyl-1,3-propanediol (MPO) is as follows.

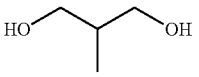

The molecular structure of diethylene glycol monomethyl ether (DGME) having the ether group is as follows.

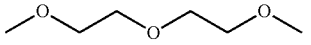

The molecular structure of 2-ethylhexan-1-ol (2-EH) is as follows.

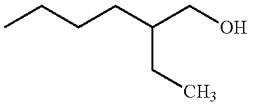

Based on cooperation of the above-mentioned raw materials, the glass transition temperature of the polymer plasticizer is within a range from −80° C. to −40° C.

Moreover, since a viscosity of the polymer plasticizer is relatively high, the polymer plasticizer cannot be easily and uniformly mixed with the polyvinyl chloride resin during a processing process, thereby causing the difficulty of the processing process.

In order to solve the above-mentioned technical issue, the fabric composition further includes less than or equal to 15 parts by weight of a processing aid. For example, the fabric composition can include 1, 2, 3, 4, 5, 6, 7, 8, 9, or 10 parts by weight of the processing aid, but the present disclosure is not limited thereto.

The processing aid is an aliphatic dibasic acid ester that is in a linear shape, and the processing aid has a second weight average molecular weight within a range from 300 to 800. In other words, the weight average molecular weight of the processing aid is less than the weight average molecular weight of the polymer plasticizer.

In terms of the material selection, the processing aid is at least one selected from the group consisting of di-octyl sebacate (DOS), di-octyl adipate (DOA), di-isononyl adipate (DINA), di-isodecyl adipate (DIDA), and di-isononyl sebacate (DINS).

According to the above configuration, the processing aid can assist in reducing the viscosity of the fabric composition, thereby enhancing the processability of the fabric composition. In addition, the processing aid can also be used as the polymer plasticizer and can enhance the leather feeling of the top fabric layer 2.

However, a content of the processing aid cannot be too high. If the content of the processing aid is too high (e.g., higher than 15 parts by weight), the top fabric layer 2 may not be able to provide the required leather feeling or the required odor level.

In one embodiment of the present disclosure, the fabric composition further includes 0.5 to 5 parts by weight of a stabilizer, and the stabilizer is configured to provide rubber thermal stability and reduce the odor level of the artificial leather.

The stabilizer is at least one selected from the group consisting of lithium stearate, magnesium stearate, calcium stearate, barium stearate, zinc stearate, magnesium laurate, barium laurate, zinc laurate, calcium ricinoleate, barium ricinoleate, zinc ricinoleate, and zinc octoate. Preferably, the stabilizer is at least one selected from the group consisting of calcium ricinoleate, barium ricinoleate, and zinc ricinoleate as metal compounds.

In one embodiment of the present disclosure, the fabric composition further includes 0 to 15 parts by weight of fillers, and the fillers are inorganic granular materials.

The fillers are at least one selected from the group consisting of: calcium carbonate, silicon dioxide, aluminium oxide, clay, talc, diatomaceous earth, and ferrite as metal oxides; glass, carbon black, and metal as fibers and powders; and glass ball, graphite, aluminum hydroxide, barium sulfate, magnesium oxide, magnesium carbonate, magnesium silicate, and calcium silicate. Preferably, the fillers are calcium carbonate, but the present disclosure is not limited thereto.

In one embodiment of the present disclosure, the fabric composition further includes 2 to 8 parts by weight of a flame retardant.

The flame retardant is at least one selected from the group consisting of: aluminum hydroxide, magnesium hydroxide, antimony trioxide, and zinc borate as inorganic compounds; cresyl diphenyl phosphate, trichloroethyl phosphate, trichloropropyl phosphate, and tris-dichloropropyl phosphate as phosphorus compounds; and chlorinated paraffin as a halogen compound. Preferably, the flame retardant is antimony trioxide, but the present disclosure is not limited thereto.

It is worth mentioning that in one embodiment of the present disclosure, the fabric composition does not include any foaming agent (e.g., a chemical foaming agent or a physical foaming agent). The top fabric layer 2 can provide the leather feeling required by the conventional artificial leather in the absence of the foaming structure or without using the foaming agent. That is to say, a pungent odor generated due to the foaming structure or use of the foaming agent can be avoided in the present disclosure.

Referring to FIG. 2, the base fabric layer 1 can be, for example, a woven fabric or a non-woven fabric. In addition, the top fabric layer 2 can be synthesized onto the base fabric layer 1, so as to form into an artificial leather with an appearance similar to that of the natural leather.

Moreover, the polyvinyl chloride artificial leather 100 can further include the surface treatment layer 3. The surface treatment layer 3 is formed by a waterborne surface treatment agent being coated onto the one surface of the top fabric layer 2 away from the base fabric layer 1. The surface treatment layer 3 can improve properties of the polyvinyl chloride artificial leather 100, such as gloss, tactile sensation, light resistance, heat resistance, dirt resistance, abrasion resistance, and scratch resistance.

One surface of the surface treatment layer 3 away from the top fabric layer 2 can be embossed at a high temperature, so as to form different patterns on the surface of the artificial leather.

In the present embodiment, the waterborne surface treatment agent is a waterborne polyurethane system agent without N-ethylpyrrolidone. Accordingly, a material composition of the surface treatment layer 3 can allow the polyvinyl chloride artificial leather 100 to have a lower odor level, thereby enhancing pleasantness of the user during use.

When the waterborne polyurethane system agent without N-ethylpyrrolidone is used as the waterborne surface treatment agent (instead of a conventional solvent-based treatment agent), solvent materials (such as toluene and xylene) that have a pungent odor and are harmful to the human body can be avoided. In addition, by using the waterborne polyurethane system agent of the present embodiment, there is no N-ethylpyrrolidone, and the pungent odor can be reduced.

It is worth mentioning that in the present embodiment, no foaming layer or foaming structure is provided between the surface treatment layer 3 and the top fabric layer 2, and the surface treatment layer 3 does not include any foaming pores, but the present disclosure is not limited thereto.

According to the above configuration, the polyvinyl chloride artificial leather 100 without the foaming structure provided in the present disclosure is applicable in an automotive interior, such as a car door panel, a dashboard, a control panel, an upright column, a seat rear panel, and a seat fabric. Naturally, the polyvinyl chloride artificial leather 100 without the foaming structure provided in the present disclosure is also applicable in other fields similar to the automotive interior.

Experimental Results

Hereinafter, Examples 1 to 4 and Comparative Example 1 will be described in detail. However, the following examples are only used to aid in understanding of the present disclosure, and are not to be construed as limiting the scope of the present disclosure.

Example 1 is implemented as follows. A fabric composition of Example 1 in Table 1 below is sequentially mixed and melted at a high temperature through a small mixer and a Banbury mixer. The fabric composition is then calendered through a calendering machine, so that the fabric composition is formed into a top fabric layer, and the top fabric layer is laminated onto a base fabric layer through a calendering process. Afterwards, a waterborne polyurethane system agent is coated onto a surface of the top fabric layer and is then dried, so as to form a surface treatment layer. Properties of a polyvinyl chloride artificial leather of Example 1 are tested, and test results are recorded in Table 1.

A polyvinyl chloride artificial leather in each of Examples 2 to 4 is prepared substantially in the same manner as Example 1, and the differences are compounds of the fabric composition. In Comparative Example 1, while no polymer plasticizer having an ether group soft segment is used, a conventional foaming structure is applied, and the plasticizer is a phenolic acid plasticizer. Manufacturing parameters of each component are recorded in Table 1.

The properties of the polyvinyl chloride artificial leather in each of Examples 1 to 4 and Comparative Example 1 are tested and obtained, and the properties include: odor level, tensile strength, elongation, static load elongation, tear strength, and peel strength. The test results are recorded in Table 1.

The odor level is measured according to the Volkswagen odor test standard PV3900C3 at 80° C. for 2 hours. An odor grading scale includes 6 levels. Level 1 means no odor. Level 2 means non-disturbing odor. Level 3 means obvious but non-disturbing odor. Level 4 means disturbing odor. Level 5 means strong and disturbing odor. Level 6 means unbearable odor.

TABLE 1

[test parameters and test results]

| Item | | Example 1 | Example 2 | Example 3 | Example 4 |
|---|---|---|---|---|---|
| compounds of top fabric layer and fabric composition | content of polyvinyl chloride resin (parts by weight) | 45 | 45 | 45 | 45 |
| | content of polymer plasticizer (parts by weight) | 40 | 40 | 40 | 40 |
| | weight average molecular weight of polymer plasticizer (Mw) | 3,321 | 5,090 | 3,385 | 3,359 |
| | concentration of ether group soft segment (wt %) | 22.5 | 22.5 | 15.0 | 15.0 |
| | glass transition temperature of polymer plasticizer (° C.) | −65 | −65 | −56 | −19 |
| | types of dibasic acid raw material | AA | AA | AA | AA |
| | types of diol raw material | MPO, DEG PTMG | MPO, DEG PTMG | MPO, DEG PTMG | MPO, DEG PTMG |
| | types of end-capped fatty alcohol | DGME | DGME | 2-EH | 2-PH |
| | content of processing aid (parts by weight) | 5 | 5 | 5 | 5 |
| | types of processing aid | DOS | DOS | DOS | DOS |
| | content of stabilizer (parts by weight) | 1 | 1 | 1 | 1 |
| | calcium ricinoleate/zinc ricinoleate | calcium ricinoleate/ zinc ricinoleate | calcium ricinoleate/ zinc ricinoleate | calcium ricinoleate/ zinc ricinoleate | calcium ricinoleate/ zinc ricinoleate |
| | content of fillers (parts by weight) | 5.5 | 5.5 | 5.5 | 5.5 |
| | types of fillers | $CaCO_3$ | $CaCO_3$ | $CaCO_3$ | $CaCO_3$ |
| | content of flame retardant (parts by weight) | 3.5 | 3.5 | 3.5 | 3.5 |
| | types of flame retardant | $Sb_2O_3$ | $Sb_2O_3$ | $Sb_2O_3$ | $Sb_2O_3$ |
| | thickness of top fabric layer (micrometer) | 250 | 250 | 250 | 250 |
| test results of properties of artificial leather | odor level (level 1 to level 6) | 3.0 | 3.0 | 3.5 | 3.5 |
| | MD tensile strength (N/3 cm) | 569 | 585 | 539 | 512 |
| | CD tensile strength (N/3 cm) | 506 | 403 | 475 | 476 |
| | MD elongation (%) | 92 | 78 | 89 | 89 |
| | CD elongation (%) | 120 | 77 | 124 | 124 |

TABLE 1-continued

[test parameters and test results]

| | | | | |
|---|---|---|---|---|
| MD static load elongation (%) | 8 | 6 | 8 | 12 |
| CD static load elongation (%) | 27 | 17 | 14 | 18 |
| MD tear strength (N) | 34 | 29 | 27 | 25 |
| CD tear strength (N) | 38 | 30 | 47 | 42 |
| MD peel strength (N/3 cm) | 18 | 15 | 17 | 19 |
| CD peel strength (N/3 cm) | 21 | 16 | 25 | 27 |
| cold resistance at −30° C. (in a hitting manner) | qualified | 10/8 | 10/5 | 10/4 |

| | Item | Comparative Example 1 |
|---|---|---|
| compounds of top fabric layer and fabric composition | content of polyvinyl chloride resin (parts by weight) | top/bottom 54/45 |
| | content of phenolic acid plasticizer 911P (parts by weight) | top/bottom 45/40 |
| | weight average molecular weight of polymer plasticizer (Mw) | N/A |
| | concentration of ether group soft segment (wt %) | N/A |
| | glass transition temperature of polymer plasticizer (° C.) | N/A |
| | types of dibasic acid raw material | N/A |
| | types of diol raw material | N/A |
| | types of end-capped fatty alcohol | N/A |
| | content of foaming agent (parts by weight) | top/bottom 0/2.5 |
| | types of processing aid | N/A |
| | content of stabilizer (parts by weight) | top/bottom 1/1 |
| | calcium ricinoleate/zinc ricinoleate | calcium ricinoleate/ zinc ricinoleate |
| | content of fillers (parts by weight) | top/bottom 0/6.5 |
| | types of fillers | $CaCO_3$ |
| | content of flame retardant (parts by weight) | top/bottom 0/5 |
| | types of flame retardant | $Sb_2O_3$ |
| | thickness of top fabric layer (micrometer) | 200/500 |
| test results of properties of artificial leather | odor level (level 1 to level 6) | 4.0 |
| | MD tensile strength (N/3 cm) | 494 |
| | CD tensile strength (N/3 cm) | 421 |
| | MD elongation (%) | 68 |
| | CD elongation (%) | 94 |
| | MD static load elongation (%) | 5.9 |
| | CD static load elongation (%) | 21 |
| | MD tear strength (N) | 29 |
| | CD tear strength (N) | 39 |
| | MD peel strength (N/3 cm) | 7 |
| | CD peel strength (N/3 cm) | 16 |
| | cold resistance at −30° C. (in a hitting manner) | qualified |

Discussion of Test Results

According to the test results, the polymer plasticizer is utilized in Examples 1 to 4. When the polymer plasticizer is within an optimized molecular weight range, the polymer plasticizer can have better compatibility with the polyvinyl chloride resin, and the polyvinyl chloride artificial leather in each of Examples 1 to 4 can provide better cold resistance and better tactile sensation. Further, when an end-capped fatty alcohol uses an ether group for the end-cap, in addition to cold resistance and tactile sensation, the odor level can also be improved. Overall speaking, compared to Comparative Example 1, the polyvinyl chloride artificial leather in each of Examples 1 to 4 is obviously improved with respect to the odor level.

Beneficial Effects of the Embodiment

In conclusion, in the polyvinyl chloride artificial leather without the foaming structure provided by the present disclosure, by virtue of "a top fabric layer is directly formed on the base fabric layer, the top fabric layer has a solid structure extendedly formed from one surface of the top fabric layer away from the base fabric layer to the base fabric layer, the solid structure is formed by a fabric composition, and the solid structure has a predetermined thickness within a range from 100 micrometers to 600 micrometers" and "the fabric composition includes 40 to 70 parts by weight of a polyvinyl chloride resin and 30 to 60 parts by weight of a polymer plasticizer, in which the polymer plasticizer has a first weight average molecular weight within a range from 1,500 to 6,000, a molecular structure of the polymer plasticizer has at least one soft segment that is in a linear shape, the at least one soft segment has an ether group, a concentration of the at least one soft segment having the ether group in the polymer plasticizer is within a range from 10 wt % to 50 wt %, and the polymer plasticizer has a glass transition temperature within a range from −80° C. to −15° C.," the odor level of the polyvinyl chloride artificial leather can be effectively improved, and the top fabric layer can provide a leather feeling in the absence of any foaming structure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A polyvinyl chloride artificial leather without a foaming structure, which has an odor level lower than 3.5 measured according to Volkswagen odor test standard PV3900C3, the polyvinyl chloride artificial leather comprising:

a base fabric layer; and a top fabric layer directly formed on the base fabric layer, wherein the top fabric layer has a solid structure extendedly formed from one surface of the top fabric layer away from the base fabric layer to the base fabric layer, the solid structure is formed by a fabric composition, and the solid structure has a predetermined thickness within a range from 100 micrometers to 600 micrometers, and wherein the fabric composition includes:

40 to 70 parts by weight of a polyvinyl chloride resin; and 30 to 60 parts by weight of a polymer plasticizer, wherein the polymer plasticizer has a first weight average molecular weight within a range from 1,500 to 6,000, a molecular structure of the polymer plasticizer has at least one soft segment that is in a linear shape, and the at least one soft segment has an ether group; wherein a concentration of the at least one soft segment having the ether group in the polymer plasticizer is within a range from 10 wt % to 50 wt %, and the polymer plasticizer has a glass transition temperature within a range from −80° C. to −15° C.

2. The polyvinyl chloride artificial leather according to claim 1, wherein no foaming layer is provided between the top fabric layer and the base fabric layer, and the solid structure of the top fabric layer does not have any foaming pores.

3. The polyvinyl chloride artificial leather according to claim 1, wherein the at least one soft segment having the ether group is embedded at a central portion or an end portion of the molecular structure of the polymer plasticizer.

4. The polyvinyl chloride artificial leather according to claim 1, wherein the polymer plasticizer is a high-molecular polyester prepared by a poly-condensation reaction between a dibasic acid raw material and a diol raw material, and the at least one soft segment having the ether group is formed by at least one of the dibasic acid raw material and the diol raw material.

5. The polyvinyl chloride artificial leather according to claim 4, wherein the dibasic acid raw material is at least one selected from the group consisting of adipic acid, maleic acid, decanedioic acid, and dodecanedioic acid.

6. The polyvinyl chloride artificial leather according to claim 4, wherein the diol raw material is at least one selected from the group consisting of diethylene glycol, triethylene glycol, tetraethylene glycol, poly-tetra-hydrofuran, propane-1,2-diol, 2-methyl-1,3-propanediol, neopentyl glycol, and 1,4-cyclohexanedimethanol.

7. The polyvinyl chloride artificial leather according to claim 4, wherein the polymer plasticizer is further end-capped by an end-capped fatty alcohol, so as to end the poly-condensation reaction; wherein the end-capped fatty alcohol is a monool, and the monool is at least one selected from the group consisting of 2-ethylhexan-1-ol, 2-propyl-heptanol, lauryl alcohol, diethylene glycol monobutyl ether, and diethylene glycol monomethyl ether.

8. The polyvinyl chloride artificial leather according to claim 1, wherein the fabric composition further includes from greater than 0 and less than or equal to 15 parts by weight of a processing aid; wherein the processing aid is an aliphatic dibasic acid ester that is in a linear shape, and the processing aid has a second weight average molecular weight within a range from 300 to 800.

9. The polyvinyl chloride artificial leather according to claim 8, wherein the processing aid is at least one selected from the group consisting of di-octyl sebacate, di-octyl adipate, di-isononyl adipate, di-isodecyl adipate, and di-isononyl sebacate.

10. The polyvinyl chloride artificial leather according to claim 1, wherein the fabric composition further includes 0.5 to 5 parts by weight of a stabilizer, 0 to 15 parts by weight of fillers, and 2 to 8 parts by weight of a flame retardant, and wherein the fabric composition does not include any foaming agent.

11. The polyvinyl chloride artificial leather according to claim 10, wherein the stabilizer is at least one selected from the group consisting of: lithium stearate, magnesium stearate, calcium stearate, barium stearate, zinc stearate, magnesium laurate, barium laurate, zinc laurate, calcium ricinoleate, barium ricinoleate, zinc ricinoleate, and zinc octoate;

wherein the fillers are at least one selected from the group consisting of: calcium carbonate, silicon dioxide, aluminium oxide, clay, talc, diatomaceous earth, and ferrite as metal oxides; glass, carbon black, and metal as fibers and powders; and glass ball, graphite, aluminum hydroxide, barium sulfate, magnesium oxide, magnesium carbonate, magnesium silicate, and calcium silicate; and wherein the flame retardant is at least one selected from the group consisting of: aluminum hydroxide, magnesium hydroxide, antimony trioxide, and zinc borate as inorganic compounds; cresyl diphenyl phosphate, trichloroethyl phosphate, trichloropropyl phosphate, and tris-dichloropropyl phosphate as phosphorus compounds; and chlorinated paraffin as a halogen compound.

12. The polyvinyl chloride artificial leather according to claim 1, further comprising a surface treatment layer formed on the top fabric layer, wherein the surface treatment layer is formed by a waterborne surface treatment agent, and the waterborne surface treatment agent is a waterborne polyurethane system agent without N-ethylpyrrolidone.

* * * * *